United States Patent [19]

Kiefer et al.

[11] 4,213,313

[45] Jul. 22, 1980

[54] RELAY CONTROL CIRCUIT FOR WASHING APPLIANCE

[75] Inventors: George E. Kiefer; LeRoy J. Herbst, both of Louisville, Ky.

[73] Assignee: General Electric Company, Louisville, Ky.

[21] Appl. No.: 26,104

[22] Filed: Apr. 2, 1979

[51] Int. Cl.[3] ..... D06F 33/02

[52] U.S. Cl. ..... 68/12 R; 134/58 D; 307/141.4; 361/191

[58] Field of Search ..... 134/57 D, 58 D, 95; 361/191; 307/141.4; 68/12 R

[56] References Cited

U.S. PATENT DOCUMENTS

| | | | |
|---|---|---|---|
| 2,842,003 | 7/1958 | Fussangle | 361/191 X |
| 3,176,197 | 3/1965 | Hoppe et al. | 361/191 |
| 3,474,315 | 10/1969 | Tomita et al. | 307/141.4 X |
| 3,805,685 | 4/1974 | Carns | 134/95 X |

FOREIGN PATENT DOCUMENTS 450526 4/1968 Switzerland .

OTHER PUBLICATIONS

Washburn, S. H. "Relay 'Trees' and Symmetric Circuits" N.Y. AIEE Technical Paper, May 1949.

*Primary Examiner*—Philip R. Coe

*Attorney, Agent, or Firm*—H. Neil Houser; Radford M. Reams

[57] ABSTRACT

A relay control circuit for controlling the operation of various electrically actuated devices in a washing appliance such as a dishwasher is disclosed. The circuit employs four relays to provide eight operating functions, including filling, draining, dispensing of additives, water circulation, water circulation with heat, and drying.

5 Claims, 4 Drawing Figures

| FUNCTIONS | R1 | R2 | R3 | R4 |
|---|---|---|---|---|
| FILL | 1 | 0 | 0 | X |
| CIRCULATE | 0 | 0 | 0 | 1 |
| CIRCULATE WITH HEAT | 0 | 0 | 1 | 1 |
| DISPENSE WASH AID #1 | 0 | 1 | 1 | X |
| DISPENSE WASH AID #2 | 1 | 1 | X | X |
| DISPENSE RINSE AID | 1 | 0 | 1 | X |
| DRAIN | 0 | 1 | 0 | 1 |
| DRY (LOW HEAT) | 0 | 0 | 1 | 0 |
| VENT OPEN | X | X | X | 0 |
| OFF | 0 | 0 | 0 | 0 |

1 = RELAY ACTIVATED
0 = RELAY NOT ACTIVATED
X = DON'T CARE

FIG. 4

RELAY CONTROL CIRCUIT FOR WASHING APPLIANCE

BACKGROUND OF THE INVENTION

This invention relates to control circuits for appliances such as dishwashers and washing machines which employ motors and solenoid actuated devices for performing various machine cycle operations such as water fill, water drain, dispensing of detergents and other additives, drying and the like. Conventionally, the approach has been to use a separate relay with each solenoid activated device and motor. The energization of the relays so employed is controlled by a mechanical or electromechanical timer or, more recently, by solid state logic controllers. In order to provide greater reliability and reduced cost, it is desirable to minimize the number of relays employed to provide the desired cycle functions.

It is accordingly an object of the present invention to provide a relay control circuit for an appliance which controls a predetermined number of functions, using a number of relays which is less than said predetermined number of functions.

It is a further object of the present invention to provide a relay control circuit for a washing appliance which uses four relays to control eight functions.

SUMMARY OF THE INVENTION

The present invention provides a relay control circuit for a washing appliance in which the number of functions controlled by the circuit exceeds the number of relays employed. In the preferred embodiment, eight dishwasher cycle functions are controlled using four relays. These cycle functions include fill, drain, circulate, circulate with heat, dispensing of wash and rinse aids, and dry. The reduction in relays is accomplished by interconnecting the contacts of the relays to provide a plurality of relay combinations. A particular function is associated with a particular relay combination such that the desired function is initiated by selecting the relay combination associated with that function. The cycle controller selects a particular relay combination by activating certain ralays and de-activating others. The relay combinations provided in the circuit of this invention allow sufficient flexibility to enable the controller to select transitional relay combinations between operative combinations to prevent the inadvertent initiation of a function which might otherwise occur as a result of a race condition in switching the relays.

BRIEF DESCRIPTION OF THE DRAWINGS

FIG. 4 is a logic truth table useful in understanding the operation of the preferred embodiment of the invention.

DETAILED DESCRIPTION OF THE PREFERRED EMBODIMENT

Figure 1:
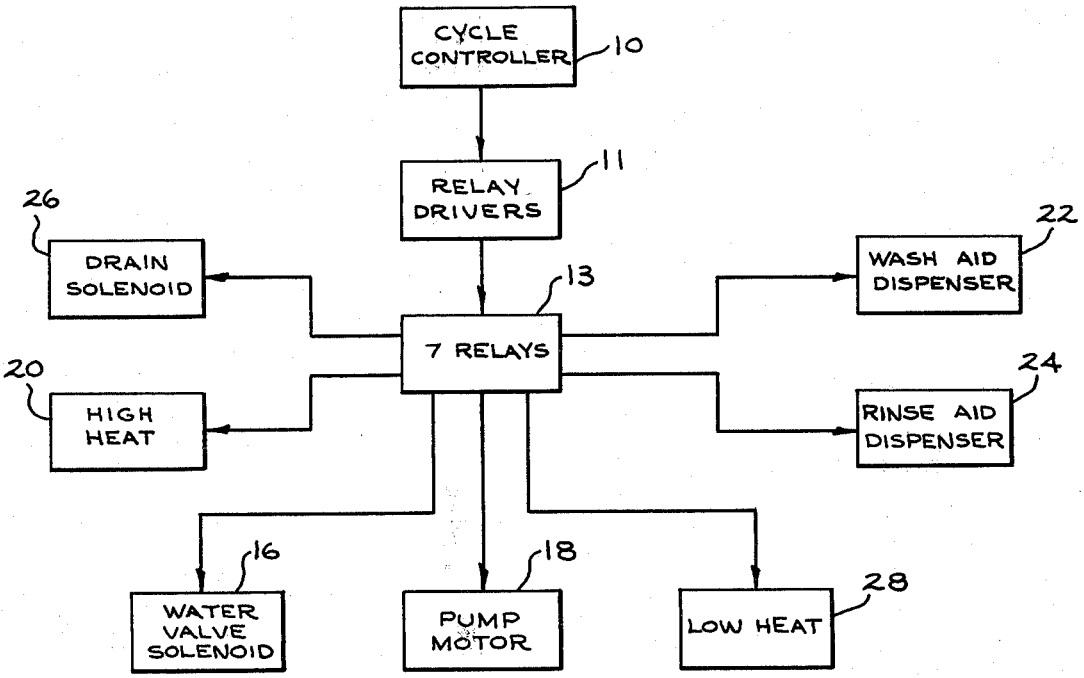
FIG. 1 PRIOR ART
FIG. 1 is a block diagram of a typical relay control system which is representative of the prior art.

Referring to FIG. 1, a block diagram of a relay control circuit employed in an appliance such as a dishwasher or clothes washing machine is illustrated which is typical of the prior art. The relay drivers 11 are selectively triggered by a cycle controller 10 which may be a mechanical, electromechanical, or solid state timer or sequencer or a microprocessor. Operation of the relay portion of the circuit is the same regardless of the type of controller employed to coordinate the triggering of the relay drivers 11. The controller switches the desired relay driver into conduction at the desired time. The relay drivers 11 activate associated relays in relay network 13 which close power circuits for the solenoids, motors and heating elements typically found in appliances of the aforementioned type. Typically, one relay is provided for each of the desired system functions. For a dishwasher which provides a wash cycle, a rinse cycle, a drain cycle and a dry cycle, the following cycle functions are desirable; water fill control, water heating, water circulation, automatic dispensing of wash aid, automatic dispensing of rinse aid, draining and heated drying. Conventionally, a separate relay has been provided for each cycle function. The desired cycle progression determines the order in which the relays in network 13 are activated by the controller 10. In FIG. 1, network 13 includes seven relays, each one being uniquely associated with one of blocks 16–28 which represent means for performing the aforementioned cycle functions.

Figure 2:
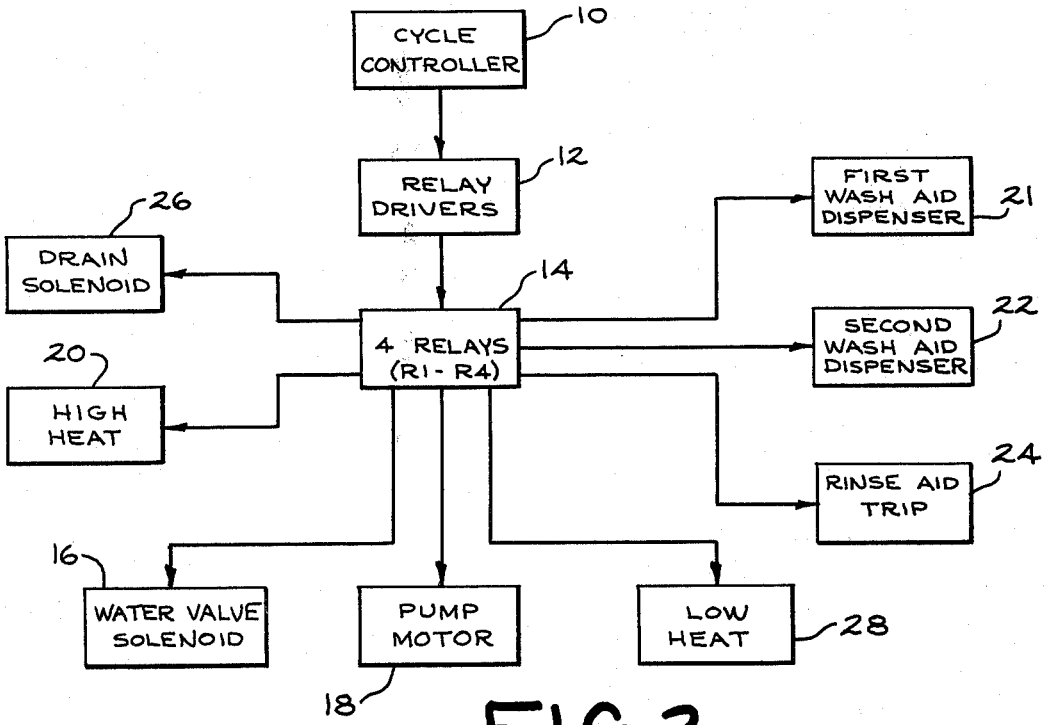
FIG. 2 is a block diagram of a relay control circuit illustrating a preferred embodiment of the present invention.

As shown in the block diagram of FIG. 2, the control circuit of the present invention reduces the seven relays of FIG. 1 to four relays to control eight functions. Although 15 relay contact pairs are employed, the reduction in relay coils in going from seven or eight relays to four relays results in a significant cost reduction. The preferred embodiment incorporates this circuit in an automatic dishwasher. This advantageous reduction in the number of relays employed results in part from a recognition of the fact that in a washing appliance such as a dishwasher, certain of the desired functions operate simultaneously. It should be recognized that the invention is equally applicable to a clothes washer for controlling a comparable number of functions although the particular functions employed in the clothes washer may differ somewhat.

A dishwasher incorporating the preferred embodiment of the control circuit of this invention provides at least the following operating cycles: a first wash cycle, a second wash cycle, a rinse cycle and a dry cycle. Other operating cycles or combinations of cycles will occur to those skilled in the art, which may be similarly implemented without departing from the present inventive concept. For example, the second wash cycle may be simply be omitted. The control system would then control seven, rather than eight, functions, the second wash aid dispensing function being deleted.

During the wash cycles, the following cycle functions are provided: a fill function typically performed by actuating a solenoid which opens a water valve, and deactuating the solenoid to close the valve when the water reaches a predetermined level or a predetermined time has elapsed; a water heating function performed by energizing a heating element at a relatively high power level with water present in the wash chamber; a water circulating function in which water is circulated in the wash chamber by dish spraying apparatus when the pump motor is energized; an automatic additive dispensing function in which a wash aid such as a liquid or dry detergent is dispensed into the wash chamber by energizing the wash aid dispensing mechanism at the desired time; and a draining function performed by energizing the pump motor and energizing a drain solenoid which actuates a means for diverting the path of the water being pumped to the drain for removal from the machine. The functional requirements for the rinse cycle are similar, substituting rinse aid dispensing for wash aid dispensing. The dry cycle requires that heat be provided to the wash chamber at a relatively low power level. In the illustrative embodiment, heat for the drying cycle is provided by energizing the same heating element used for heating the water but at a lower power level. However, a separate heating element of a lower power rating could be employed.

Figure 3:
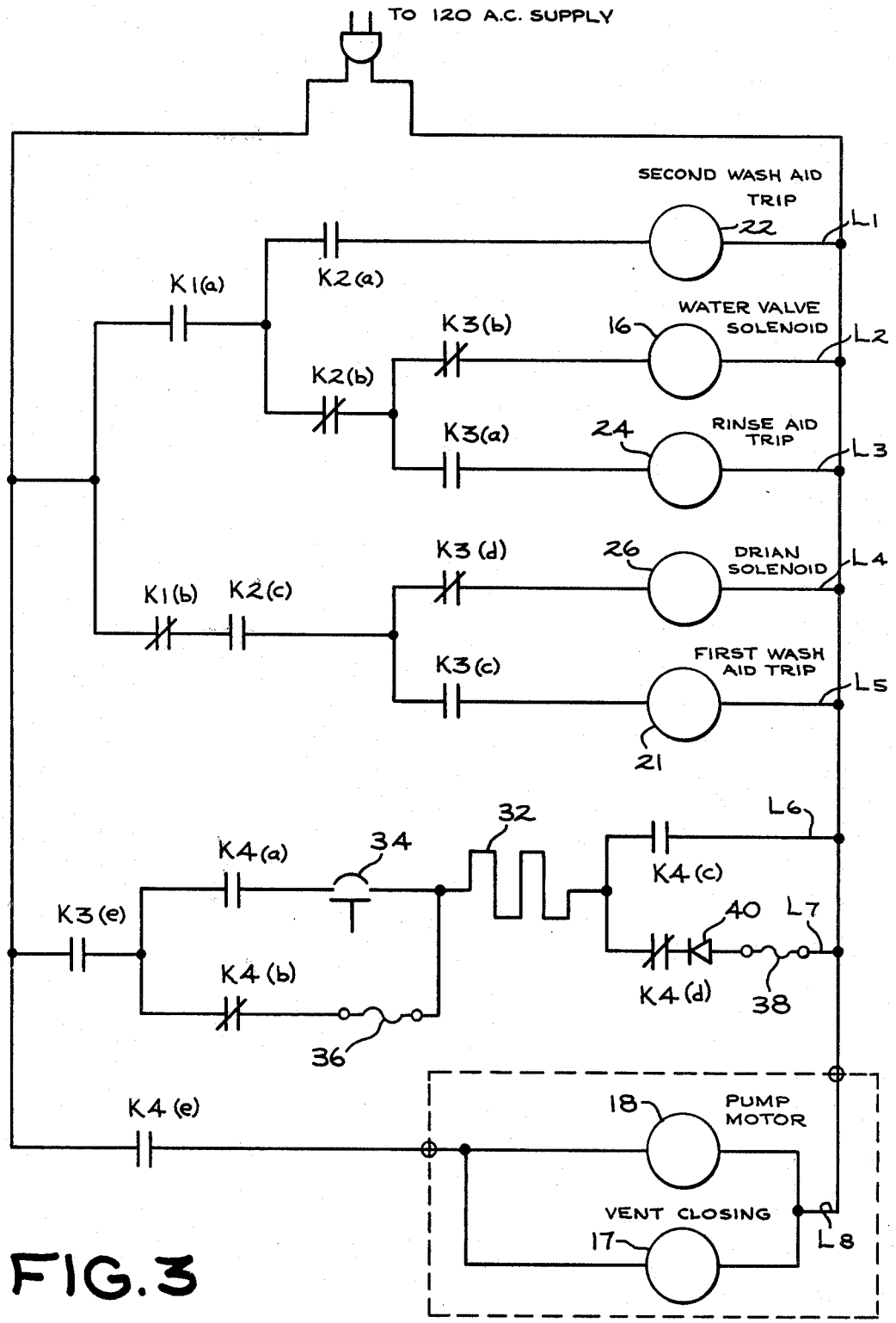
FIG. 3 is a schematic diagram of the relay control circuit for the preferred embodiment of the present invention.

FIG. 3 is a schematic diagram of a portion of the system of FIG. 2 which illustrates the manner in which the contacts for the four relays of FIG. 2 are arranged in various combinations by interconnecting the contacts so that different ones of the various function performing means 16–28 are enabled by the selection of particular combinations of relays by the cycle controller (item 10, FIG. 2) to perform the required cycle functions. The relay coils and circuitry for activating the coils are not shown in order to avoid unduly complicating the circuit, it being understood that such circuitry is conventional and well known in the art.

Four relays R1–R4 have contacts designated K1–K4, respectively. The relays are of the double throw type, each having at least one set of contacts which are normally open (NO) and one set of contacts which are normally closed (NC). R1 is preferably a single pole relay having one set of normally open contacts K1(NO) and one set of normally closed contacts K1(NC); R2 is a double pole relay having two sets of normally open contacts K2(NO) and two sets of normally closed contacts K2(NC), and R3 and R4 are triple pole relays, each having three sets of normally open contacts K3(NO) and K4(NO), respectively, and three sets of normally closed contacts K3(NC) and K4(NC), respectively.

The circuit of FIG. 3 includes eight lines, designated L1–L8, which are arranged for parallel connection across a 120 volt AC power supply typical of power service available in the home. Line L1 includes second wash aid trip mechanism 22 connected in series with first normally open contacts K1(NO), designated K1(*a*), and K2(NO), designated K2(*a*). Line 12 includes a water valve solenoid 16 connected in series with first normally closed contacts K3(NC) and K2(NC), designated K3(*b*), and K2(*b*), respectively, and normally open contacts K1(*a*). Line L3 includes rinse aid trip mechanism 24 connected in series with first normally open contacts K3(NO), designated K3(*a*), normally closed contacts K2(*b*) and normally open contacts K1(*a*). Line L4 includes drain solenoid 26, connected in series with second normally closed contacts K3(NC), designated K3(*d*), second normally open contacts K2(NO), designated K2(*c*) and normally closed contacts K1(*b*). Line L5 includes first wash aid trip mechanism 21 connected in series with second normally open contacts K3(NO) and K2(NO) designated K3(*c*), and K2(*c*), respectively, and normally closed contacts K1(*b*). Line L6 includes heating element 32 connected in series with first and second normally open contacts K4(NO) designated K4(*a*) and K4(*c*), respectively, third normally open contacts K3(NO) designated K3(*e*) and a thermostatic switch 34. Line L7 includes heating element 32 in series with current limiting fuses 36 and 38, diode 40, first and second normally closed contacts K4(NC) designated K4(*b*) and K4(*d*), respectively, and normally open contacts K3(*e*). Line 8 includes pump motor 18 and vent closing mechanism 17 connected in parallel, the parallel combination being connected in series with third normally open contacts K4(NO) designated K4(*e*). Vent closing means 17 could as well be connected in series with pump motor 18.

The circuit of FIG. 3 includes means for providing heat at two energy levels, high heat for heating the water during wash and rinse cycles and low heat for drying the dishes during the dry cycle. The means for providing high heat comprises a conventional resistive heating element 32 arranged in the circuit for direct connection across the AC power supply. The means for providing low heat comprises heating element 32 arranged for connection across the power supply in serial connection with a unidirectional current device 40. Thus, resistive heating element 32 is energized at full power in the high heat mode and at half power in the low heat mode.

For operation in the high heat mode a relay combination in which relays R3 and R4 are activated is selected. In this mode heating element 32 is arranged for direct connection across the AC power via normally open contacts K3(*e*), K4(*a*) and K4(*c*) and thermostatic switch 34. The thermostat 34 is not essential to circuit operation but is provided to prevent overheating the wash chamber as might occur if the heating element were operated at full power in the absence of sufficient water. If thermostat 34 is omitted from the circuit, both normally open contacts 44(*a*) and normally closed contacts K4(*b*) and fuse 36 may be likewise omitted. Relay R4 may then be a double pole double throw relay. For operation in the low heat mode, a relay combination in which R3 is activated and R4 is not activated is selected. In this mode, heating element 32 is switched in series with diode 40 via normally closed contacts K4(*d*), for connection across the power supply via another set of normally closed contacts K4(*b*), normally open contacts K3(*e*) and current limiting fuses 36 and 38.

During the wash and rinse cycles pump motor 18 is energized to circulate water in the wash chamber of the appliance and during the drain cycle to remove water from the wash chamber. During those cycles in which pump motor 18 is operating, it is desirable to close the vent provided in the appliance for allowing air circulation during the drying cycle. Therefore, vent closing mechanism 17 which closes the vent and retains it in the closed position when actuated, is connected with pump motor 18 either in parallel (as shown in FIG. 3) or, alternatively, in series such that the vent closing mechanism is actuated when the pump motor is energized.

In addition to controlling eight cycle functions to provide the necessary operating cycles, a further requirement on the relay circuit of FIG. 3 is that when the relay combination in which each of the relays R1–R4 is inactivated is selected, none of the functions are operative; that is, each of the function performing means is placed in its non-operating state. This is accomplished in the circuit of FIG. 3 by arranging the interconnection of relay contacts such that when all four relays are inactivated lines L1–L8 are all open circuits, leaving all of the function performing means in their non-operative states.

FIG. 4 is a logic truth table in which the relay combinations for each function are defined in terms of the state of each relay in the combination. The left column of the table lists the functions. Each of the remaining four columns lists the state of one of relays R1–R4. A one state is a relay column indcates that that relay is activated, that is, its normally open contacts are closed and its normally closed contacts are open. A zero state indicates that the relay is not activated, that is, its normally closed contacts are closed and its normally open contacts are open. An X state represents a "don't care" condition in which the state of that relay has no effect on the corresponding function. Thus, each row represents as a four-bit code the combination of activated and non-activated relays associated with the function for that row which when selected enables that function to be performed.

Referring now to FIG. 3 and FIG. 4, the operation of the illustrative embodiment of the circuit of this invention will be described. For performance of the fill function the state of the relays is shown to be 100X. Selection of this relay combination enables water to be admitted to the wash chamber of the appliance by activaing relay R1 which closes normally open contacts K1(*a*) and not activating R2 and R3, thereby energizing water valve solenoid 16 on line L2 via normally open contacts K1(*a*) and normally closed contacts K2(*b*) and K3(*b*). The table of FIG. 4 indicates that for the fill function the state of relay 4 is inconsequential. However, it may be desirable to provide static fill, that is fill without circulation, during certain fill cycles, and to provide a dynamic fill, that is simultaneous fill and circulate, during other fill cycles. For a dynamic fill, the circulating pump is energized while water is entering the wash chamber; for a static fill the pump is not energized. In the circuit of FIG. 3, pump motor 18 is energized when relay R4 is activated. Thus, for a dynamic fill the state of the relays is 1001; for a static fill the state is 1000. The controller can provide a static fill or a dynamic fill as desired by properly selecting the state of relay R4. The drain function requires tha both drain solenoid 26 and pump motor 18 can be energized. This is accomplished by activating only relays R2 and R4, corresponding to relay combination 0101. Drain solenoid 26 is energized via normally closed contacts K1(*b*) and K3(*d*) and normally open contacts K2(*c*); and pump motor 18 is energized via normally closed contacts K4(*e*). The first wash aid dispensing function is accomplished by selecting the relay combination 011X, thereby energizing first wash aid dispenser mechanism 21, via normally closed contacts K1(*b*) and normally open contacts K2(*c*) and K3(*c*) by activating only R2 and R3. The state of relay R4 is irrelevant to this function. For the second wash aid dispensing function, second wash aid dispenser mechanism 22 is energized via normally open contacts K1(*a*) and K2(*a*), by activating relays R1 and R2 corresponding to relay combination 11XX. The state of relays R3 and R4 is irrelevant to this function. The rinse aid dispensing function is accomplished by energizing rinse aid dispensing mechanism 24 via normally open contacts K1(*a*) and K3(*a*) and normally closed contacts K2(*b*) by activating relays R1 and R3 corresponding to combination 101X. The state of relay R4 is irrelevant to this function. The circulate with heat function is performed when only R3 and R4 are activated, combination 0011. In this mode, heating element 32 is operated at full power, being coupled directly to the input power line via normally open contacts K3(*e*), K4(*a*) and K4(*c*) and thermostat 34. Pump motor 18 is energized via normally open contacts K4(*e*). For the circulate with no heat function, only relay R4 is activated (0001), energizing pump motor 18 via normally open contacts K4(*e*). Finally, for the drying function in the preferred embodiment, heating element 32 is energized at half power. This is accomplished in the circuit of FIG. 3 by connecting heating element 32 in series with diode 40 via contacts K4(*d*) and connecting this serial combination to the power supply via normally open contacts K3(*e*), normally closed contacts K4(*b*) and fuses 36 and 38, by activating only relay R3 (0010).

The above-described functions are performed in a dishwasher to provide the following sequences of steps during normal dishwasher operation: Fill, circulate with heat, drain; fill, dispense washing aid, circulate with heat, drain; fill, circulate with heat, drain; fill, dispense rinse aid, circulate, drain; dry.

In switching the relays from one step or function to the next in providing the above sequences, care must be taken to avoid a race condition in the relays which may initiate an undesired function resulting from the occurrence of an unintended intermediate state. For example, referring to the truth table of FIG. 4 it will be observed that the state of the relays for fill is (100X) and the state for circulate with heat is (0011). In switching from (100X) to (0011), if relay R3 were activated before relay R1 is de-activated, an intermediate state (101X) would exist at least briefly. This state, as seen in the truth table, trips the rinse aid dispensing mechanism.

In order to avoid race condition problems, the relay combinations are arranged so that there are sufficient states which can be interposed as transition states between operative states to avoid inadvertently initiating undesired functions. These transition states are either inoperative states, that is, states which do not initiate any functions, or operative states which initiate functions, the intermediate performance of which will not adversely affect system performance. Operative states which perform satisfactorily as transition states are those states which initiate functions which are compatible with the subsequent desired operative function. For example, state 0001 which initiates pump motor operation, is compatible with any of the functions except the dry function and the static fill function since motor operation does not adversely affect system operation. However, it is particularly important that dispensing of the wash and rinse aids does not occur inadvertently since the presence of wash aid during rinse or rinse aid during wash would seriously adversely affect system performance. Thus, states 011X or 11XX which dispense wash aid are incompatible with the rinse function; and, similarly, state 101X which dispenses rinse aid is incompatible with the wash function. The relay control circuit of the present invention provides sufficient flexibility in state selection so that the cycle controller can be arranged to select transition states intermediate certain operative states to prevent inadvertent initiation of unwanted functions when changing from one selected operative relay combination to another. A description of one embodiment in which the cycle controller selects certain transition states follows.

In the example situation involving the transition from fill to circulate with heat, transition state 0001 is employed to avoid the inadvertent tripping of the rinse aid dispenser. The controller switches the relays from state 100X to state 0001, and then to state 0011 in going from fill to circulate with heat. In this instance, and transition state initiates the circulate function between the fill and circulate with heat function. Obviously, this transition state is compatible with the next desired function, namely circulate with heat. This transition is completed by activating relay R3 to provide the heat function. In the transition from circulate with heat to drain and drain to fill, this same transition state is employed. This state is again compatible with the succeeding operative states because the pump motor which is energized in this state is to be energized in all of these functions. The transition from fill to dispense wash aid #1 involves the two transition states 0000 and 0100, both of which are inoperative states. Similarly, in the transition from dispense wash aid #2 to circulate with heat, two transition states are employed, 1111 and 0111. State 1111 merely actuates second wash aid dispensing mechanism, and state 0111 trips first wash aid dispensing mechanism. At this point in the cycle, these states are compatible. Since both the first and second wash aids have been dispensed earlier in the cycle, these steps do not introduce additional additive into the wash chamber and thus do not adversely affect system performance. Finally, in the transition from drain to dry, inoperative transition state 0000 is employed.

Modifications and alterations of this invention will become apparent to those skilled in the art from the foregoing discussion, and it should be understood that this invention is not limited to the specific embodiment illustrated and described herein. It is intended to cover by the following claims all modifications coming within the spirit and scope thereof.

We claim:

1. A control circuit for controlling a predetermined number of washing appliance functions comprising:

a plurality of relays, said number of relays being less than said predetermined number of functions;

the contacts of said relays being interconnected to form a plurality of distinct relay combinations;

means for performing each of said functions;

each one of said performing means being placed in its operative state in response to the selection of a different one of said relay combinations; and controller means for selecting each of said distinct relay combinations by selectively activating and inactivating different ones of said plurality of relays;

said plurality of distinct relay combinations including at least one transition relay combination which is automatically selected by said controller means in changing from at least one desired operative relay combination to a second desired operative relay combination, to prevent the initiation of unwanted functions resulting from the inadvertent selection of an incompatible relay combination in changing between said desired operative relay combinations, said transition combination being compatible with said second desired combination;

whereby performance of each of said functions is initiated by selection of the specific combination of activated and inactivated relays associated with that function.

2. The control circuit of claim 1 wherein said transition combination comprises that relay combination which when selected places each of said function performing means in its non-operative state.

3. The control circuit of claim 1 wherein said plurality of function performing means includes:

means for dispensing wash aid;

means for dispensing rinse aid;

means for controlling the flow of water into said appliances;

means for controlling the flow of water out of said appliances;

a pump motor;

a heating means; and means for providing two energy settings for said heating means;

said at least one transitional relay combination selected by said controller means being operative to prevent inadvertent placement of said wash aid dispensing means and said rinse aid dispensing means in their operating states when changing from one operational relay combination to another.

4. A circuit for an appliance for controlling eight appliance functions, F1-F8, said circuit comprising:

four relays, R1-R4;

relay R1 including a set of relay contacts K1 comprising a set of normally open contacts K1(NO) and a set of normally closed contacts K1(NC);

relay R2 including relay contacts K2 comprising first and second sets of normally open contacts K2(NO) and first and second sets of normally closed contacts K2(NC);

relays R3 and R4 including relay contacts K3 and K4, respectively, each comprising first, second and third sets of normally open contacts K3(NO) and K4(NO), respectively, and first, second and third sets of normally closed contacts K3(NC) and K4(NC), respectively;

means M1-M8, for performing each of said functions F1-F8, respectively;

each of said means being arranged for coupling to an external AC power supply via serial connection with selected sets of normally open and normally closed contacts K1-K4, the selected sets being serially connected with each means as follows:

(i) K1(NO), a first K2(NO) and M1;

(ii) said K1(NO), a first K2(NC), a first K3(NC) and M2;

(iii) said K1(NO), said first K2(NC), a first K3(NO) and M3;

(iv) a k1(NC), a second K2(NO), and a second K3(NC) and M4;

(v) said K1(NC), said second K2(NO), a second K3(NO), and M5;

(vi) a third K3(NO), a first K4(NO), a second K4(NO), and M6;

(vii) said third K3(NO), a first K4(NC), a second K4(NC), and M7;

(viii) a third K4(NO) and M8 and controller means for selectively sequentially activating and inactivating particular combinations of said relays whereby performance of each function F1-F8 is initiated by said controller means selected the particular combination of activated and inactivated relays, corresponding to the desired function; said controller means being operative to select at least one transition relay combination in changing from certain ones of said relay combinations to prevent the initiation of unwanted functions resulting from the inadvertent selection of an incompatible relay combination.

5. The circuit of claim 4 wherein:

means M1 comprises a first wash aid dispensing means;

means M2 comprises means for controlling the flow of water into the appliance;

means M3 comprises rinse aid dispensing means;

means M4 comprises means for controlling the flow of water out of the appliance;

means M5 comprises a second wash aid dispensing means;

means M6 comprises a heater means for providing high heat;

means M7 comprises said heater means in series with a unidirectional current device for providing low heat; and means M8 comprises pump means.

* * * * *